US005526992A

United States Patent [19]

Hawén et al.

[11] Patent Number: 5,526,992

[45] Date of Patent: Jun. 18, 1996

[54] REFINING ELEMENT OF A DISC REFINER

[75] Inventors: Anders Hawén, Tyresö ; Christer Hedlund, Stockholm; Christer Nästrén, Upplands Väsby; Pertti Purolainen, Bro; Lennart Rohdén, Enskede; Nils Virving, Vällingby, all of Sweden

[73] Assignee: Sunds Defibrator Industries Aktiebolag, Sweden

[21] Appl. No.: 318,611

[22] PCT Filed: Jan. 28, 1993

[86] PCT No.: PCT/SE93/00059

§ 371 Date: Oct. 7, 1994

§ 102(e) Date: Oct. 7, 1994

[87] PCT Pub. No.: WO93/20941

PCT Pub. Date: Oct. 28, 1993

[30] Foreign Application Priority Data

Apr. 8, 1992 [SE] Sweden ..... 9201116

[51] Int. Cl.[6] ..... B02C 7/06; B02C 7/12

[52] U.S. Cl. ..... 241/298; 241/261.2

[58] Field of Search ..... 241/261.2, 261.3, 241/296, 297, 298, 300

[56] References Cited

U.S. PATENT DOCUMENTS

| | | | |
|---|---|---|---|
| 25,243 | 8/1853 | Brevoort | 241/298 |
| 272,642 | 10/1904 | Carr | 241/262.2 |
| 2,119,768 | 6/1938 | Anthony | 241/296 |
| 3,459,379 | 8/1969 | Brown | 241/298 X |
| 3,910,511 | 10/1975 | Leider et al. | 241/298 X |
| 4,201,350 | 5/1980 | Eagens | 241/298 |
| 5,383,617 | 1/1995 | Deuchars | 241/298 |

FOREIGN PATENT DOCUMENTS 344423 4/1972 Sweden .

*Primary Examiner*—Timothy V. Eley

*Attorney, Agent, or Firm*—Lerner, David, Littenberg, Krumholz & Mentlik

[57] ABSTRACT

A refining element is disclosed for use in a disk refiner having a refining element holder surface including a plurality of attachment holes, the refining element including a plurality of working members on its front surface and a rear surface adapted to be attached to the refining element holder, the refining element further includes a plurality of attachment through holes extending through the refining element for attachment to the refining element holder at corresponding attachment holes therein, whereby attachment screws can be provided for affixing the refining element to the refining element holder through the plurality of attachment through holes, and at least one removal hole including threads and being substantially centrally located on the refining element, whereby the refining element can be removed from the refining element holder by extending a removal screw through the removal hole to apply pressure for removal of the refining element against the refining element holder.

5 Claims, 1 Drawing Sheet

REFINING ELEMENT OF A DISC REFINER

FIELD OF THE INVENTION

This present invention relates to a refining element for disk refiners. The present element invention also relates to such refining elements provided on their front side with working members for defibering and refining lignocellulose-containing fiber material. The refining element further is formed with through holes for attaching it on a holder in the refiner by means of screws.

BACKGROUND OF THE INVENTION

In using refining elements on such disk refiners, a plurality of such refining elements are attached to the refiner in the form of a ring about each of two opposed holders, which are rotary relative to each other. Both holders can be rotated in opposed directions, or one holder can be rotary and one stationary.

During refining, the material to be refined passes through the refining gap, which is formed between refining elements on the opposed holders. During said passage, the material is simultaneously worked. This working normally takes place during continuous operation under high pressure and temperature, whereby the working members on the front sides of the refining elements are subjected to wear. Due to such wear, the quality of the worked fiber material deteriorates, so that the refining elements must be exchanged after a certain period of time. This time can amount to several months.

During the necessary exchange of the refining elements, it has been found that the old elements have become so rigidly stuck, due to baked fibers and extracted substances, that they can be removed only with great trouble and after a long period of time. In many cases it is not sufficient to merely loosen the holding screws. Since the refining elements are fixed very tightly on the holder, there is no space for removing them by prying. In certain cases it has thus been necessary to knock off or cut to pieces one of the elements in order to be able to remove the elements, which moreover involves the risk of accidents. After one of the elements has been removed, it is then relatively simple to take off the remaining elements.

SUMMARY OF THE INVENTION

In accordance with the present invention, the aforementioned problems have now been solved by the invention of a refining element for use in a disk refiner having a refining element holder surface including a plurality of attachment holes thereon, the refining element comprising a front surface and a rear surface, the front surface including a plurality of working members and the rear surface adapted for attachment to the refining element holder, the refining element further comprising a plurality of attachment through holes extending through the refining element for attaching the refining element to the refining element holder at corresponding attachment holes therein, whereby attachments screws can be provided for affixing the refining element to the refining element holder through the plurality of attachment through holes, and at least one removal hole, the removal hole including threads and being substantially centrally located on the refining element whereby the refining element can be removed from the refining element holder by extending a removal member through the removal hole to apply pressure for removal of the refining element against the refining element holder.

In accordance with one embodiment of the refining element of the present invention, the plurality of working members on the front surface of the refining element comprise a plurality of bar members.

In accordance with another embodiment of the refining element of the present invention, a covering screw is provided for application to the removal hole for filling the removal hole during use of the refining element in the disk refiner.

In accordance with a preferred embodiment of the refining element of the present invention, the refining element can be removed from the refining element holder by removing the covering screw, and wherein the removal member comprises a removal screw having a length greater than the thickness of the refining element.

In accordance with another embodiment of the refining element of the present invention, the length of the covering screw is less than the thickness of the refining element, and the covering screw includes a head portion. Preferably, the length of the covering screw is less than the thickness of the refining element by a distance of between about 1 and 3 mm, and the head portion of the covering screw is located between about 1 and 3 mm below the front surface of the refining element.

The present invention thus provides for the design of a refining element which makes it possible to rapidly and simply remove refining elements from a holder in a disk refiner with satisfactory safety for both staff and the equipment itself.

BRIEF DESCRIPTION OF THE DRAWINGS

The present invention may be more fully appreciated with reference to the following detailed description, which, in turn, makes reference to the Figures in which.

DETAILED DESCRIPTION

Figure 1:
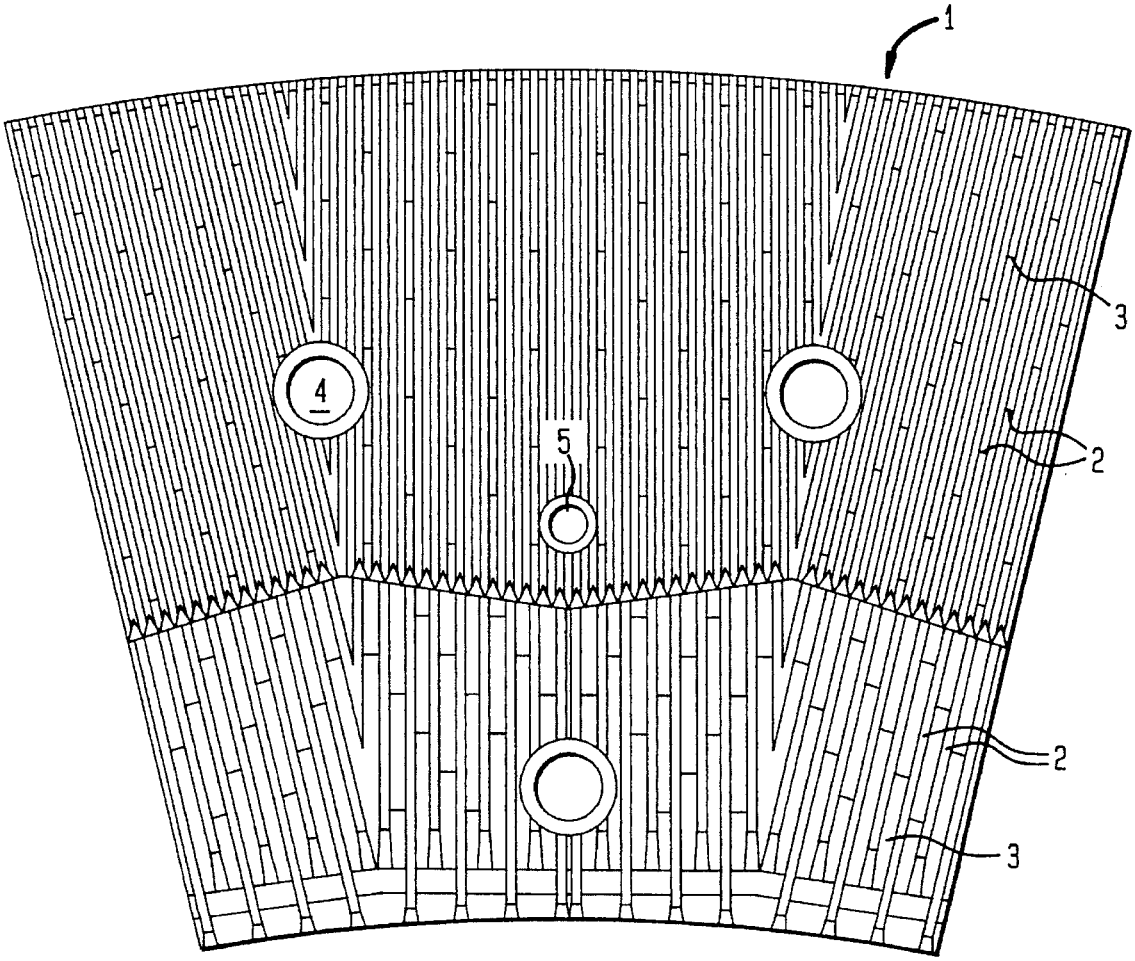
FIG. 1 is a top, elevational view of a refining segment in accordance with the present invention.
Figure 2:
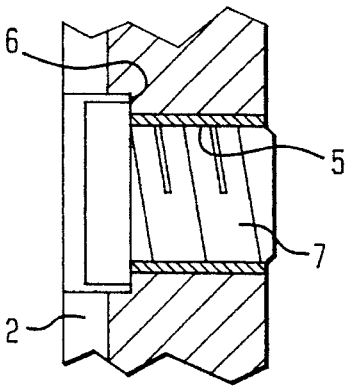
FIG. 2 is an enlarged front view of a portion of the refining element shown in FIG. 1.
Figure 3:
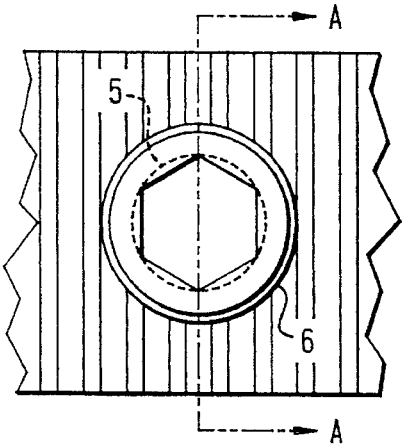
FIG. 3 is a side view of the portion of the refining element shown in FIG. 2 taken along section A—A thereof.

The refining element 1 shown in FIG. 1 is formed on its front side with working embers in the form of bars 2 with intermediate grooves 3. Through holes 4, usually three in number, are provided for attaching the element on the holder in the disk refiner. These holes are located so that good abutment to the holder is obtained. The attachment is carried out by the screws, which are tightened from the front side into corresponding threaded holes in the holder.

The refining element 1 is further provided with a threaded hole 5 located centrally on the refining element, preferably close to its center of gravity. About the hole 5 a zone 6 without bars is located. In threaded hole 5 a covering screw 7 is attached in such a manner, that the zone 6 about the hole provides sufficient contact surface for the head of the covering screw 7 to be locked against the material in the refining element 1. Normally one single threaded hole 5 is sufficient, but it is, of course, possible to have two or more threaded holes. In such cases, a covering screw is to be attached in every such threaded hole.

The head of the covering screw 7 is formed so that it is located preferably 1–3 mm beneath the working surface of the bars 2. The screw head preferably is formed for an internal hexagon spanner. The covering screw 7 extends only just through the refining element, and in operation sits in the hole 5 in order to prevent fibers from penetrating between the refining element and the holder. When the refining element is to be removed, first the attachment screws are loosened. They are not, however, entirely threaded out of the holes in the holder. The covering screw 7, however, is screwed out of the hole 5. Thereafter a longer screw, a bursting screw, is screwed into the hole 5. When this bursting screw arrives at the holder lying behind the refining element, it lifts the refining element up from the holder with continued screwing. The force achievable in this has been found to be sufficient for rapidly and simply loosening the refining element, which otherwise could not be loosened without great problems, as set forth above. The remaining attachment screws prevent the refining element from flying off in an uncontrolled manner when loosened from the holder.

Alternatively, the threaded hole 5 can be used for pulling out the refining element. In this case the attachment screws are screwed out entirely. A clamp can be attached by means of long screws, which extend through attachment holes 4 of the refining element and are tightened in the holder. By means of this clamp and a longer screw to be attached in the threaded hole 5, the refining element can thereafter be pulled out. The clamp in this case prevents the refining element from flying off if it loosens abruptly.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A refining element for use in a disk refiner having a refining element holder surface including a plurality of attachment holes thereon, said refining element comprising:

a front surface and a rear surface, said front surface including a plurality of working members and said rear surface adapted for attachment to said refining element holder, said refining element further comprising a plurality of attachment through holes extending through said refining element for attaching said refining element to said refining element holder at corresponding attachment holes therein, attachment screws provided for affixing said refining element to said refining element holder through said plurality of attachment through holes, at least one removal hole located within said refining element, a covering screw for filling said removal hole during use of said refining element in said disk refiner, said covering screw having a length less than the thickness of said refining element, a removal screw having the length greater than the thickness of said refining element, whereby said refining element can be removed from said refining element holder by removing said covering screw and extending said removal screw through said removal hole to apply pressure for removal of said refining element against said refining element holder.

2. The refining element of claim 1 wherein said plurality of working members on said front surface of said refining element comprise a plurality of bar members.

3. The refining element of claim 1 wherein said length of said covering screw is less than the thickness of said refining element by a distance of between about 1 and 3 mm, whereby said head portion of said covering screw is located between about 1 and 3 mm below the said front surface of said refining element.

4. The refining element of claim 1, wherein said removal hole includes threads and is centrally located within said refining element and said covering screw is formed with a head portion.

5. The refining element of claim 4, wherein said head portion is formed with an internal hexagon area.

* * * * *

UNITED STATES PATENT AND TRADEMARK OFFICE

CERTIFICATE OF CORRECTION

PATENT NO. : 5,526,992

DATED : June 18, 1996

INVENTOR(S) : Hawén *et al.*

It is certified that error appears in the above-identified patent and that said Letters Patent is hereby corrected as shown below:

Column 4, line 16, delete "the" (first instance) and insert therefor --a--.

Signed and Sealed this

Twenty-first Day of January, 1997

*Attest:*

*Attesting Officer*

BRUCE LEHMAN

*Commissioner of Patents and Trademarks*